US006682158B2

(12) United States Patent
Lai

(10) Patent No.: US 6,682,158 B2
(45) Date of Patent: Jan. 27, 2004

(54) CABINET ASSEMBLY AND DRAWER LIMITING DEVICE THEREFORE

(76) Inventor: Yung-Tsai Lai, No. 13, Tung-Kuang 8th St., Pei Dist., Taichung City (TW)

( * ) Notice: Subject to any disclaimer, the term of this patent is extended or adjusted under 35 U.S.C. 154(b) by 63 days.

(21) Appl. No.: 10/151,850

(22) Filed: May 22, 2002

(65) Prior Publication Data

US 2003/0184197 A1 Oct. 2, 2003

(51) Int. Cl.[7] ..... A47B 88/16
(52) U.S. Cl. ..... 312/333; 312/334.46
(58) Field of Search ..... 312/330.1, 333, 312/334.27, 334.31, 334.36, 334.44, 334.1, 334.46

(56) References Cited

U.S. PATENT DOCUMENTS

| | | | | | |
|---|---|---|---|---|---|
| 922,852 | A | * | 5/1909 | Cannan | 312/333 |
| 4,125,297 | A | * | 11/1978 | Mertes | 312/334.27 |
| 5,203,620 | A | * | 4/1993 | McLennan | 312/334.46 |
| 5,795,044 | A | * | 8/1998 | Trewhella et al. | 312/333 |
| 6,250,730 | B1 | * | 6/2001 | Roth et al. | 312/333 |

FOREIGN PATENT DOCUMENTS

| | | | | |
|---|---|---|---|---|
| GB | 177937 | * | 4/1922 | 312/333 |
| GB | 620113 | * | 3/1949 | 312/334.44 |

* cited by examiner

*Primary Examiner*—James O. Hansen
(74) *Attorney, Agent, or Firm*—Banner & Witcoff, Ltd.

(57) ABSTRACT

A drawer limiting device for a cabinet assembly includes a mounting plate adapted to be fastened to a drawer, and a limiting member with a head portion secured to the mounting plate and a tail portion extending rearwardly from the head portion. The tail portion has an abutment section adjacent to the head portion and adapted to project downwardly relative to a lower end of the drawer. The abutment section is adapted to abut against a transverse horizontal bar of a cabinet body so as to limit extension of the drawer relative to the cabinet body. The tail portion of the limiting member is deformable, and can be pushed upwardly by the horizontal bar by virtue of resiliency of the limiting member when the drawer is further applied with a pulling force at the extended position, thereby permitting removal of the drawer from the cabinet body.

15 Claims, 6 Drawing Sheets

CABINET ASSEMBLY AND DRAWER LIMITING DEVICE THEREFORE

BACKGROUND OF THE INVENTION

1. Field of the Invention

The present invention relates to a cabinet assembly with a slidable drawer and a drawer limiting device therefore, more particularly to a drawer limiting device which can ensure controlled removal of the drawer from a cabinet body.

2. Description of the Related Art

Referring to FIG. 1, a conventional cabinet is shown to include upper and lower drawers 11 mounted slidably in a cabinet body 10. The cabinet body 10 has upper and lower horizontal bars 12 provided at a front end thereof for limiting extension of the upper and lower drawers 11 from the front end of the cabinet body 10. Each of the drawers 11 has a rear end portion provided with a generally hemi-spherical stop member 14, and is slidable along a respective support rod 13 that is provided in the cabinet body 10 and that extends in a front-to-rear direction transverse to the horizontal bars 12. The stop member 14 projects relative to a bottom side 111 of the drawer 11, and abuts against the corresponding horizontal bar 12 when the drawer 11 is pulled forwardly relative to the cabinet body 10 to an extended position.

When it is desired to remove the drawer 11 from the cabinet body 10, the drawer 11 is first moved to the extended position, and is then tilted to raise its rear end portion so as to enable the stop member 14 to climb over the corresponding horizontal bar 12, thereby permitting removal of the drawer 11 from the cabinet body 10. However, the tilting operation for removing the drawer 11 is difficult to conduct, especially when heavy objects are received in the drawer 11. In this case, the horizontal bar 12 and the stop member 14 are likely to be deformed or even damaged.

SUMMARY OF THE INVENTION

Therefore, the main object of the present invention is to provide a cabinet assembly with a slidable drawer and a drawer limiting device which can ensure controlled removal of the drawer from a cabinet body.

According to a first aspect of the present invention, a cabinet assembly includes a cabinet body, a drawer, and a drawer limiting device. The cabinet body has an open front end, a rear end, a horizontal support rod extending between the front and rear ends, and a horizontal bar disposed adjacent to the front end and extending transverse to the support rod. The drawer is mounted slidably in the cabinet body, and is slidable forwardly and rearwardly along the support rod so as to be movable between an extended position, in which the drawer is extended from the front end of the cabinet body, and a retracted position, in which the drawer is retracted into the cabinet body. The horizontal bar on the cabinet body is disposed below the drawer. The drawer has a lower end and a rear end portion. The drawer limiting device is mounted on the rear end portion of the drawer, and includes a mounting plate fastened to the drawer, and a resilient limiting member which has a head portion secured to the mounting plate and a tail portion extending rearwardly from the head portion. The tail portion of the limiting member has an abutment section adjacent to the head portion and projecting downwardly relative to the lower end of the drawer. The abutment section abuts against the horizontal bar to limit forward extension of the drawer relative to the cabinet body when the drawer is moved to the extended position. The tail portion of the limiting member is deformable and is pushed upwardly by the horizontal bar by virtue of resiliency of the limiting member when the drawer is further applied with a forward pulling force at the extended position such that the limiting member ceases to limit forward extension of the drawer, thereby permitting removal of the drawer from the cabinet body.

According to a second aspect of the present invention, a drawer limiting device is adapted for use in a cabinet assembly which includes a cabinet body with an open front end provided with a horizontal bar and a drawer mounted slidably in the cabinet body and disposed above the horizontal bar. The drawer is slidable in forward and rearward directions transverse to the horizontal bar for moving between an extended position, in which the drawer is extended from the front end of the cabinet body, and a retracted position, in which the drawer is retracted into the cabinet body. The drawer limiting device includes a mounting plate and a resilient limiting member. The mounting plate is adapted to be fastened to the drawer. The limiting member has a head portion secured to the mounting plate, and a tail portion extending rearwardly from the head portion. The tail portion of the limiting member has an abutment section adjacent to the head portion and adapted to project downwardly relative to a lower end of the drawer. The abutment section is adapted to abut against the horizontal bar so as to limit forward extension of the drawer relative to the cabinet body. The tail portion of the limiting member is deformable, and is adapted to be pushed upwardly by the horizontal bar by virtue of resiliency of the limiting member when the drawer is further applied with a pulling force at the extended position in the forward direction such that the limiting member ceases to limit forward extension of the drawer, thereby permitting removal of the drawer from the cabinet body.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 4:
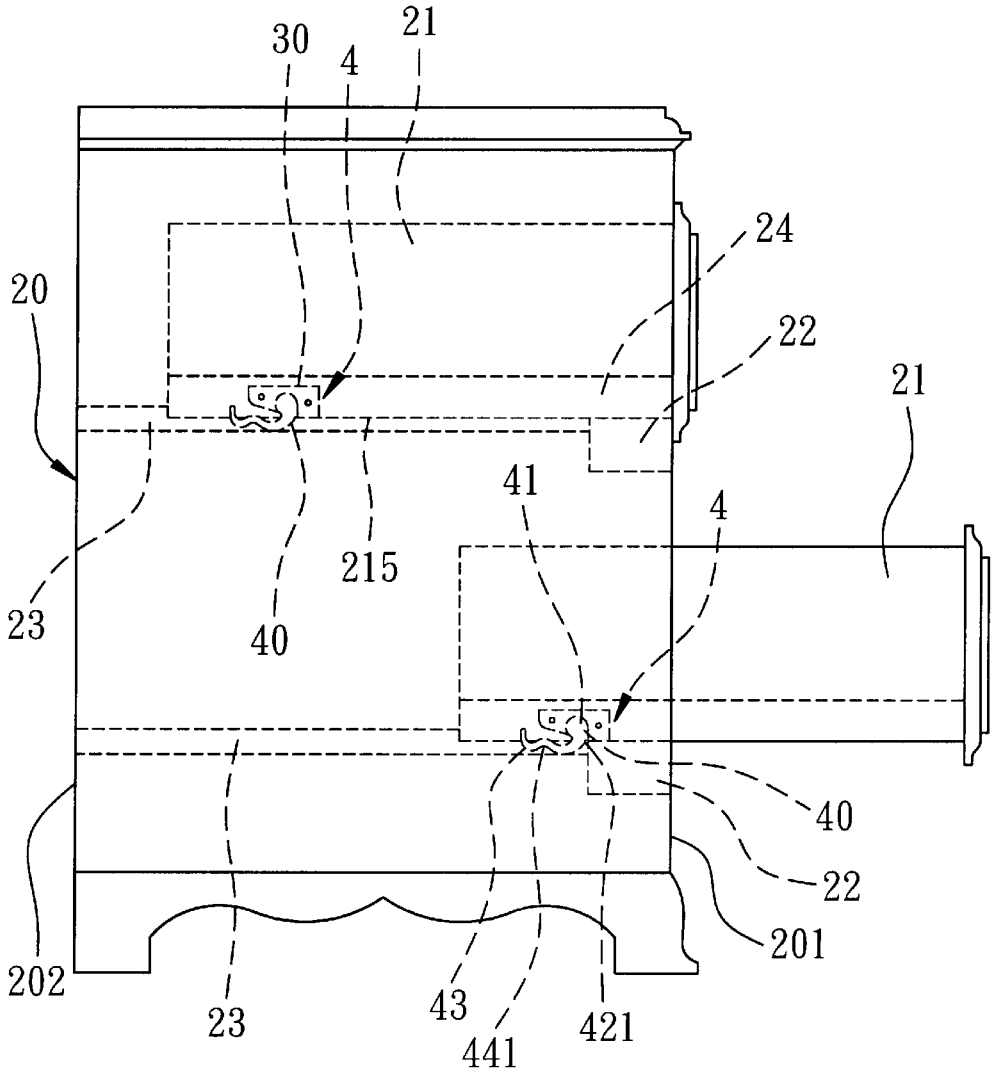
FIG. 4 is a lateral side view of the cabinet assembly of the preferred embodiment, where an upper drawer thereof is disposed in a retracted position, and a lower drawer thereof is disposed in an extended position.

Referring to FIG. 4, the preferred embodiment of the cabinet assembly according to the present invention is shown to include a hollow cabinet body 20, upper and lower drawers 21 mounted slidably in the cabinet body 20, and drawer limiting devices 4 mounted respectively on the drawers 21.

The cabinet body 20 has an open front end 201, a rear end 202, upper and lower horizontal support rods 23 extending in a front-to-rear direction between the front and rear ends 201, 202, and upper and lower horizontal bars 22 disposed adjacent to the front end 201 and extending transverse to the support rods 23.

The drawers 21 are mounted in the cabinet body 20, and are disposed on the support rods 23, respectively. Each of the drawers 21 is slidable along a respective one of the support rods 23 in forward and rearward directions.

Figure 1:
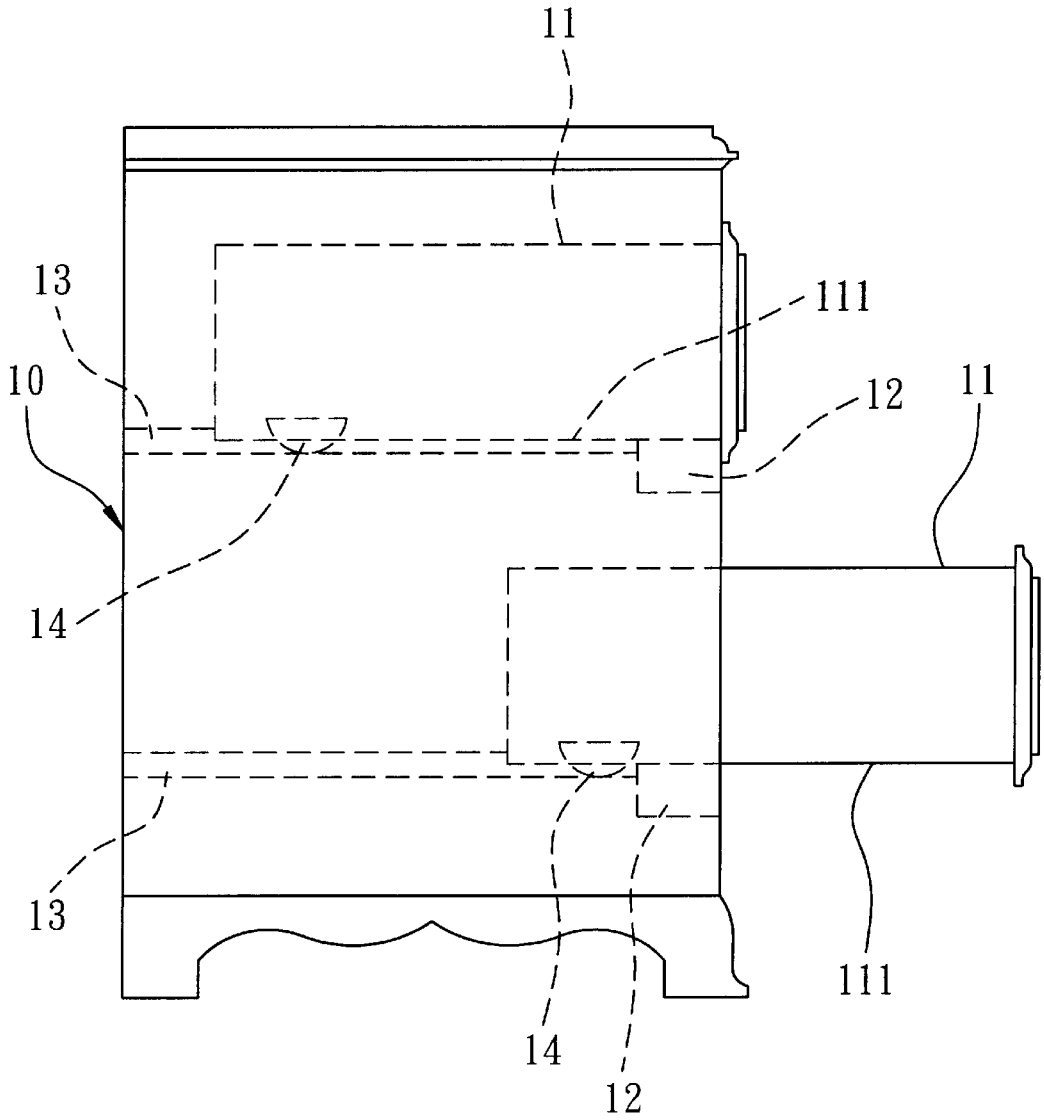
FIG. 1 PRIOR ART
FIG. 1 is a lateral side view showing a conventional cabinet with drawers.
Figure 2:
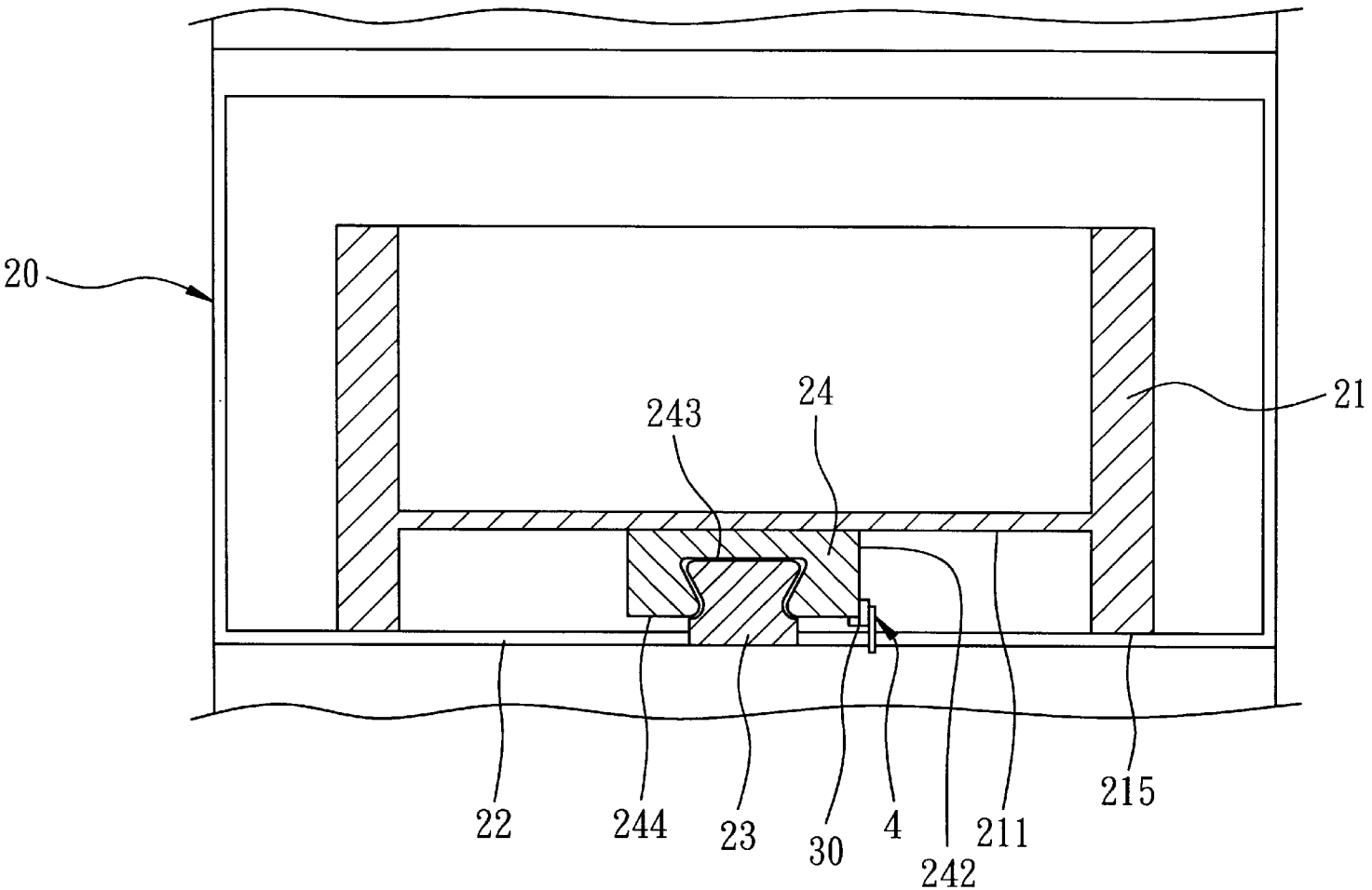
FIG. 2 is a fragmentary partly sectional view of a preferred embodiment of the cabinet assembly according to the present invention.

Referring to FIG. 2, each of the drawers 21 has a slide rail 24 secured to a bottom side 211 thereof. The slide rail 24 extends in the front-to-rear direction transverse to the corresponding horizontal bar 22, and is formed with a downwardly opening slide groove 243, which extends along the length of the slide rail 24. The slide groove 243 is formed as a dovetail groove, and engages slidably a respective one of the support rods 23 to enable sliding movement of the drawers 21 along the support rods 23, respectively. Each of the horizontal bars 22 of the cabinet body 20 is disposed immediately below a lower end 215 of a respective one of the drawers 21.

Figure 3:
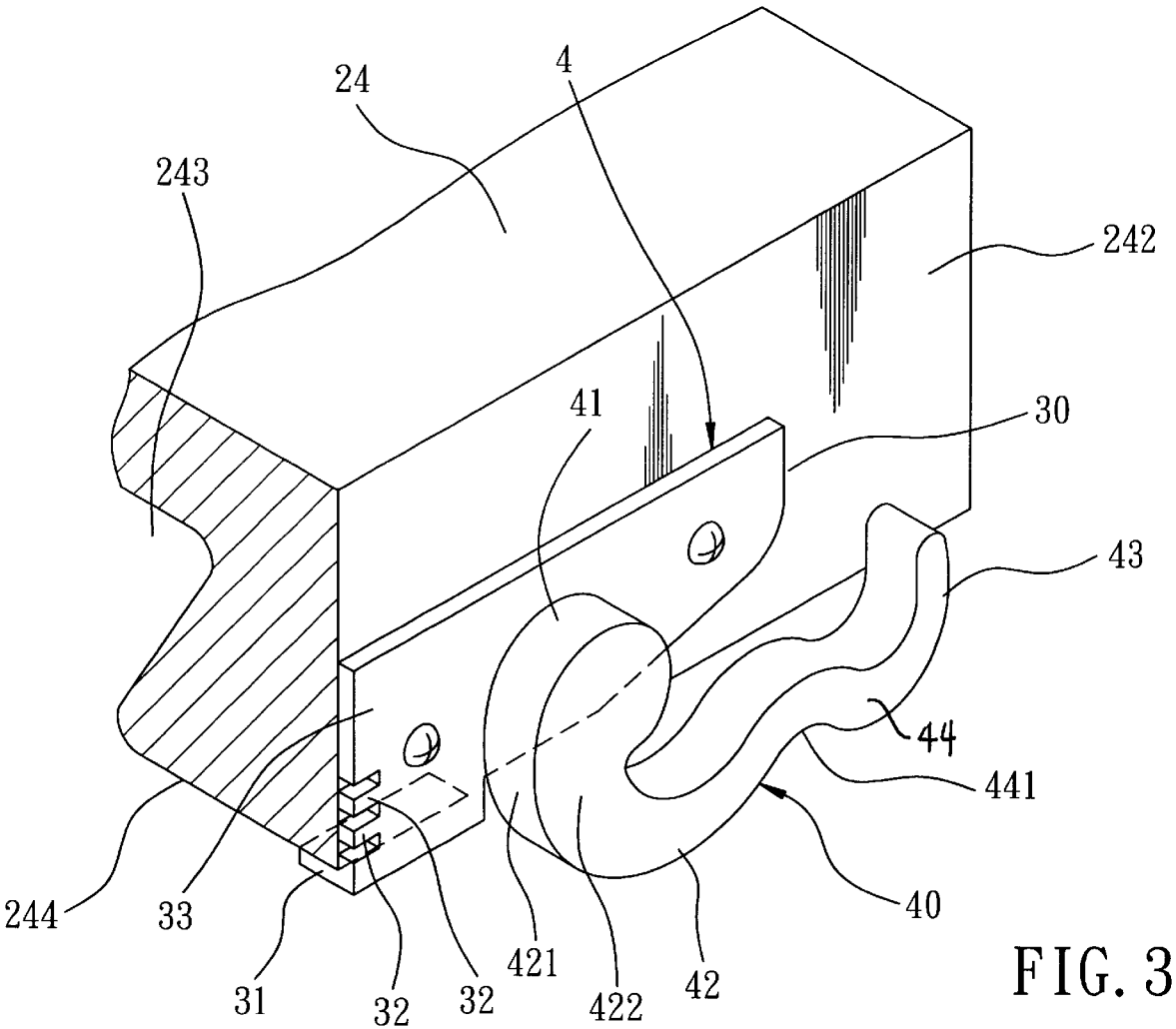
FIG. 3 is a fragmentary perspective partly cutaway view of the cabinet assembly of FIG. 2, showing a drawer limiting device mounted on a drawer of the cabinet assembly.

Referring to FIGS. 2 to 4, each of the drawer limiting devices 4 is mounted on a lateral side surface 242 of the slide rail 24 of a respective one of the drawers 21, and is disposed at a rear end portion of the respective drawer 21. Each of the drawer limiting device 4 includes an L-shaped mounting plate 30 with an upright plate portion 33 fastened or adhered to the lateral side surface 242 of the slide rail 24 of the respective drawer 24, and a horizontal plate portion 31 disposed adjacent to a bottom surface 244 of the slide rail 24. The upright plate portion 33 is provided with vertically spaced apart markers 32.

Each of the drawer limiting device 4 further includes a limiting member 40 which is formed integrally from a resilient material of a relatively high strength, such as plastic steel. The limiting member 40 has a head portion 41 secured to the upright plate portion 33 of the mounting plate 30, and a tail portion 42 extending rearwardly from the head portion 41. The tail portion 42 has an abutment section 422 adjacent to the head portion 41, a distal end 43 opposite to the head portion 41, and a retaining section 44 between the abutment section 422 and the distal end 43. The abutment section 422 extends downwardly and rearwardly from the head portion 41 along a curved path, and projects downwardly relative to the lower end 215 of the respective drawer 21. The abutment section 422 defines a convex abutment face 421 that faces forwardly. The retaining section 44 extends rearwardly from the abutment section 422, and has a curved configuration that defines a downwardly opening retaining groove 441. The distal end 43 turns upwardly from the retaining section 44.

In use, each of the drawers 21 is operable to slide between an extended position, in which the drawer 21 is extended from the front end 201 of the cabinet body 20, such as the state of the lower drawer 21 shown in FIG. 4, and a retracted position, in which the drawer 21 is retracted into the cabinet body 20, such as the state of the upper drawer 21 shown in FIG. 4. At the extended position, the abutment face 421 on the abutment section 422 of the limiting member 40 abuts against an upper rear edge of the horizontal bar 22 to resist further sliding movement of the drawer 21 in the forward direction away from the cabinet body 20.

Figure 5:
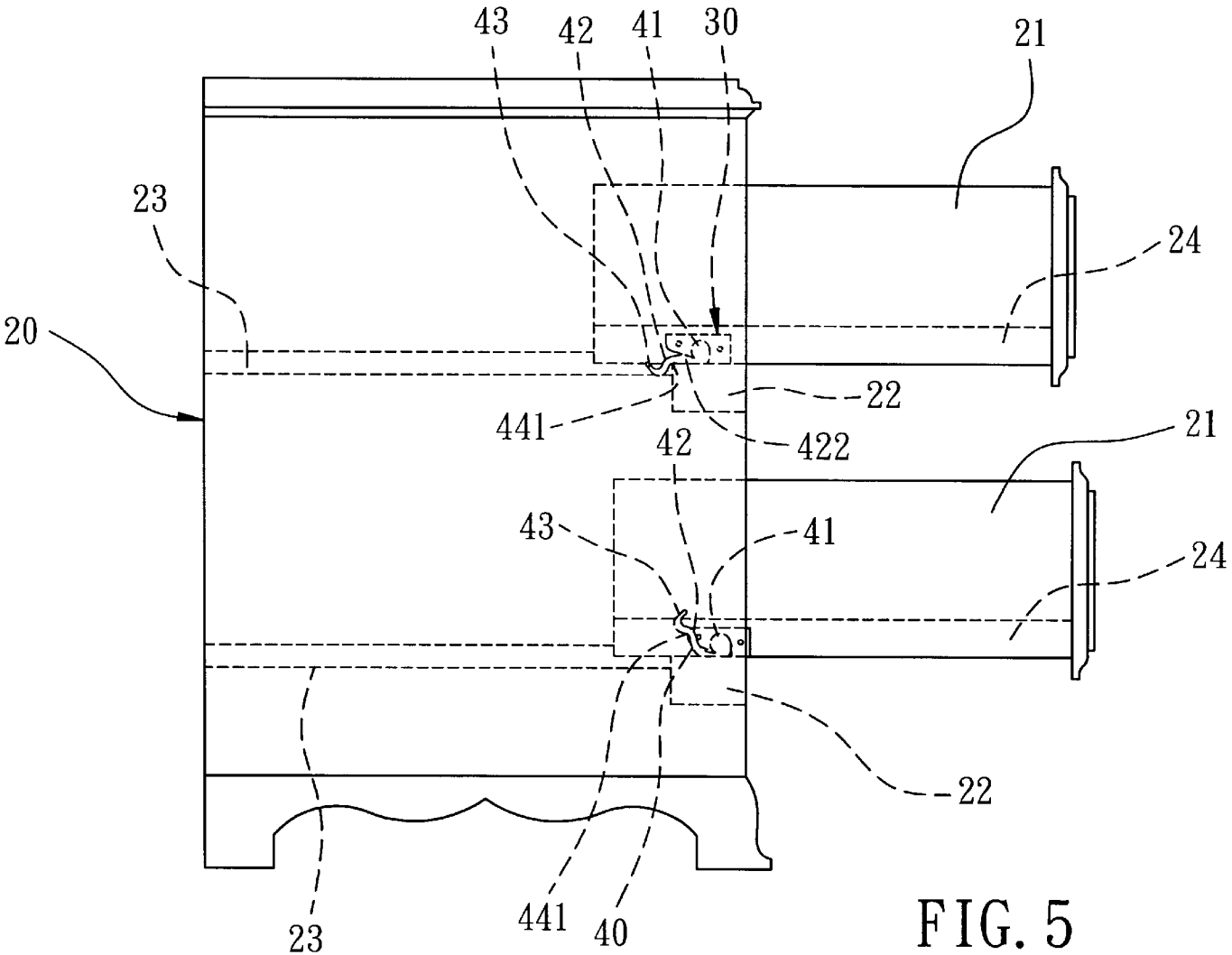
FIG. 5 is another lateral side view of the cabinet assembly of the preferred embodiment to illustrate how the upper and lower drawers can be removed from a cabinet body of the cabinet assembly.

Referring to FIG. 5, when the drawer 21 is further applied with a greater pulling force in the forward direction while it is at the extended position, the abutment section 422 will deform and will be pushed upwardly by the upper rear edge of the horizontal bar 22 so as to move past the same by virtue of the resiliency of the limiting member 40. The upper rear edge of the horizontal bar 22 then engages the retaining groove 441 in the retaining section 44, such as the state of the upper drawer 21 shown in FIG. 5. The resiliency and the deformation of the abutment section 422 provide a buffering effect to retard forward sliding movement of the drawer 21 once the latter reaches the extended position. When the horizontal bar 22 engages the retaining groove 441, the drawer limiting device 4 applies a resisting force to once again limit further sliding movement of the drawer 21 in the forward direction. Under this state, when the drawer 21 is continued to be pulled in the forward direction, the retaining section 44 would be pushed upwardly by the horizontal bar 22 and thus ceases to hinder forward sliding movement of the drawer 21, such as the state of the lower drawer 21 shown in FIG. 5, thereby permitting removal of the drawer 21 from the cabinet body 20.

Figure 6:
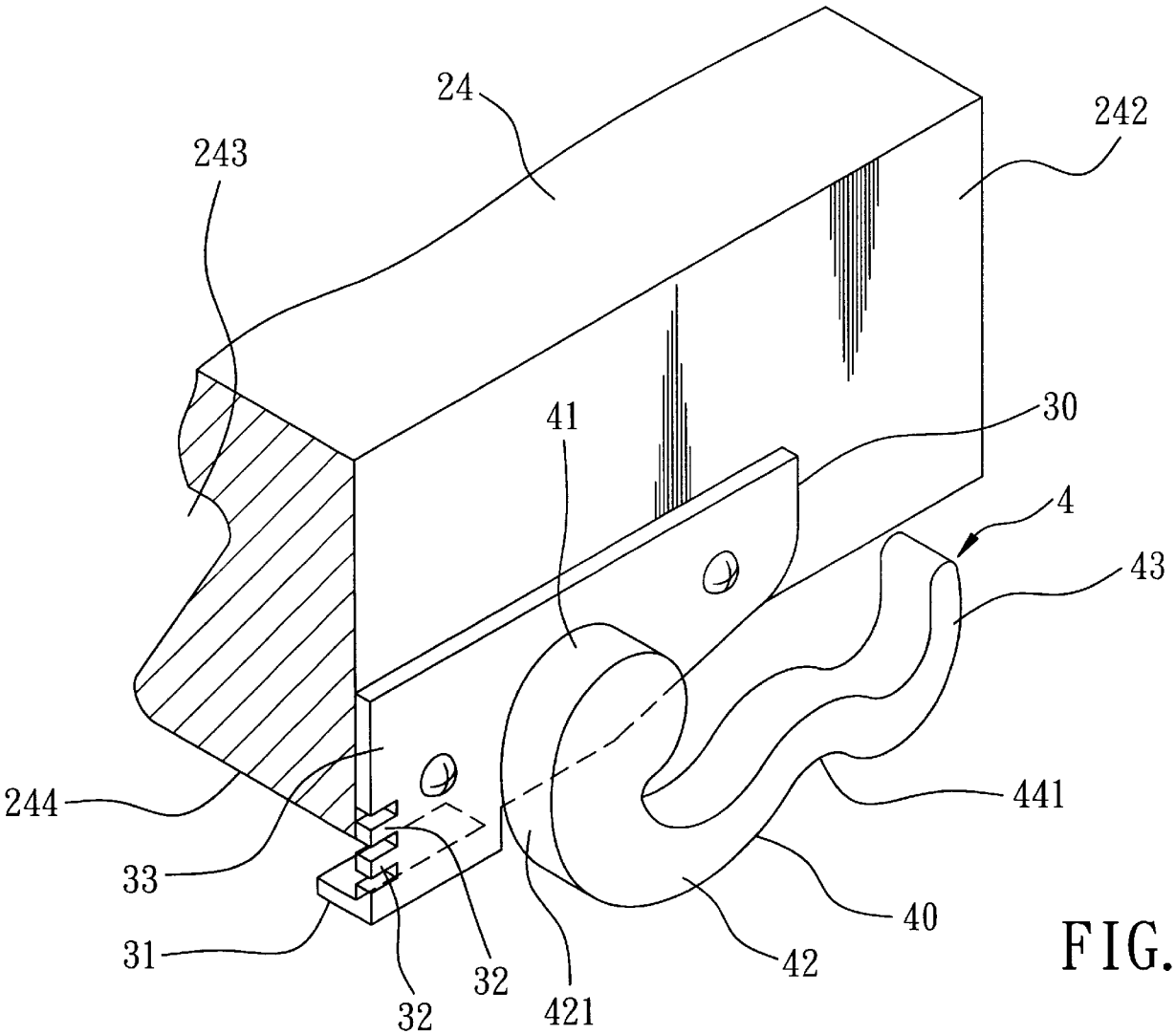
FIG. 6 shows the drawer limiting device at an adjusted position on the drawer.

Referring to FIG. 6, during fastening of the mounting plate 30 to the slide rail 24 of the drawer 21, the position of the mounting plate 30 can be adjusted by aligning a selected one of the markers 32 with the bottom surface 244 of the slide rail 24 so as to ensure that the abutment section 422 of the limiting member 44 is disposed at a level lower than the lower end 215 (see FIG. 2) of the drawer 21. This allows the drawer limiting device 4 to be adapted for use with drawers of different sizes.

Therefore, with the provision of the resilient limiting member 40, the drawer limiting device 4 can limit extension of the drawer 21, and can also buffer the fast sliding movement of the drawer 21 during the drawer removal operation when the drawer 21 reaches the extended position. As there is no need for tilting the drawer 21, the drawer limiting device 4 thus provides added convenience when the drawer 21 is to be removed.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A cabinet assembly comprising:

a cabinet body having an open front end, a rear end, a horizontal support rod extending between said front and rear ends, and a horizontal bar disposed adjacent to said front end and extending transverse to said support rod;

a drawer mounted slidably in said cabinet body and slidable forwardly and rearwardly along said support rod so as to be movable between an extended position, in which said drawer is extended from said front end of said cabinet body, and a retracted position, in which said drawer is retracted into said cabinet body, said horizontal bar on said cabinet body being disposed below said drawer, said drawer having a lower end and a rear end portion; and a drawer limiting device mounted on said rear end portion of said drawer, said drawer limiting device including a mounting plate fastened to said drawer, and a resilient limiting member which has a head portion secured to said mounting plate and a tail portion extending rearwardly from said head portion, said tail portion of said limiting member having an abutment section adjacent to said head portion and projecting downwardly relative to said lower end of said drawer, said abutment section abutting against said horizontal bar to limit forward extension of said drawer relative to said cabinet body when said drawer is moved to the extended position, said tail portion of said limiting member being deformable and being pushed upwardly by said horizontal bar by virtue of resiliency of said limiting member when said drawer is further applied with a forward pulling force at the extended position such that said limiting member ceases to limit forward extension of said drawer, thereby permitting removal of said drawer from said cabinet body.

2. The cabinet assembly as claimed in claim 1, wherein said limiting member of said drawer limiting device is formed integrally from plastic steel.

3. The cabinet assembly as claimed in claim 1, wherein said abutment section of said tail portion of said limiting member has a convex abutment face which faces forwardly and which abuts against said horizontal bar when said drawer is moved to the extended position.

4. The cabinet assembly as claimed in claim 1, wherein said horizontal bar has an upper rear edge for abutting against said tail portion of said limiting member, said tail portion of said limiting member further having a distal end opposite to said head portion, and a retaining section between said abutment section and said distal end, said retaining section defining a retaining groove that engages releasably said upper rear edge of said horizontal bar after said abutment section has moved past said upper rear edge to releasably retain said drawer at the extended position.

5. The cabinet assembly as claimed in claim 1, wherein said drawer has a bottom side provided with a slide rail which extends transverse to said horizontal bar, said slide rail being formed with a downwardly opening slide groove that extends along length of said slide rail, said support rod of said cabinet body extending into said slide groove such that said slide rail is slidable relative to said support rod when said drawer is moved between the extended and retracted positions.

6. The cabinet assembly as claimed in claim 5, wherein said slide groove is a dovetail groove.

7. The cabinet assembly as claimed in claim 5, wherein said slide rail has a lateral side surface, said mounting plate of said drawer limiting device being fastened to said lateral side surface.

8. The cabinet assembly as claimed in claim 7, wherein said slide rail further has a bottom surface connected to said lateral side surface, said mounting plate having an L-shaped configuration and including a horizontal plate portion disposed adjacent to said bottom surface of said slide rail, and an upright plate portion extending upwardly from said horizontal plate portion and fastened to said lateral side surface of said slide rail, said head portion of said limiting member being secured to said upright plate portion.

9. The cabinet assembly as claimed in claim 8, wherein said upright plate portion is provided with vertically spaced apart markers.

10. A drawer limiting device for a cabinet assembly which includes a cabinet body with an open front end provided with a horizontal bar and a drawer mounted slidably in the cabinet body and disposed above the horizontal bar, the drawer being slidable in forward and rearward directions transverse to the horizontal bar for moving between an extended position, in which the drawer is extended from the front end of the cabinet body, and a retracted position, in which the drawer is retracted into the cabinet body, said drawer limiting device comprising:

a mounting plate adapted to be fastened to the drawer; and a resilient limiting member having a head portion secured to said mounting plate, and a tail portion extending rearwardly from said head portion, said tail portion of said limiting member having an abutment section adjacent to said head portion and adapted to project downwardly relative to a lower end of the drawer, said abutment section being adapted to abut against the horizontal bar so as to limit forward extension of the drawer relative to the cabinet body, said tail portion of said limiting member being deformable and being adapted to be pushed upwardly by the horizontal bar by virtue of resiliency of said limiting member when the drawer is further applied with a pulling force at the extended position in the forward direction such that said limiting member ceases to limit forward extension of the drawer, thereby permitting removal of the drawer from the cabinet body.

11. The drawer limiting device as claimed in claim 10, wherein said limiting member is formed integrally from plastic steel.

12. The drawer limiting device as claimed in claim 10, wherein said abutment section of said tail portion of said limiting member has a convex abutment face which faces forwardly and which is adapted to abut against the horizontal bar when the drawer is moved to the extended position.

13. The drawer limiting device as claimed in claim 10, wherein said tail portion of said limiting member further has a distal end opposite to said head portion, and a retaining section between said abutment section and said distal end, said retaining section defining a retaining groove that is adapted to engage releasably an upper rear edge of the horizontal bar after said abutment section has moved past the upper rear edge to releasably retain the drawer at the extended position.

14. The drawer limiting device as claimed in claim 10, the drawer having a bottom surface and a lateral side surface connected to the bottom surface, wherein said mounting plate has an L-shaped configuration and includes a horizontal plate portion adapted to be disposed adjacent to the bottom surface of the drawer, and an upright plate portion extending upwardly from said horizontal plate portion and adapted to be fastened to the lateral side surface of the drawer, said head portion of said limiting member being secured to said upright plate portion.

15. The cabinet assembly as claimed in claim 14, wherein said upright plate portion is provided with vertically spaced apart markers.

* * * * *